US005189782A

United States Patent [19]

Hickey

[11] Patent Number: 5,189,782

[45] Date of Patent: Mar. 2, 1993

[54] METHOD OF MAKING INTEGRALLY FORMED AND TUNED FUEL RAIL/INJECTORS

[75] Inventor: John C. Hickey, Ypsilanti, Mich.

[73] Assignee: Ford Motor Company, Dearborn, Mich.

[21] Appl. No.: 793,885

[22] Filed: Nov. 18, 1991

Related U.S. Application Data

[62] Division of Ser. No. 630,913, Dec. 20, 1990, Pat. No. 5,086,743.

[51] Int. Cl.[5] ..... H01F 41/02

[52] U.S. Cl. ..... 29/602.1; 123/456; 123/470; 239/585.4; 239/585.5; 251/129.21; 264/272.19

[58] Field of Search ..... 29/602.1, 606; 264/272.19; 251/129.21, 129.15; 123/456, 470, 468, 469; 239/585.2, 585.4, 585.5, 600

[56] References Cited

U.S. PATENT DOCUMENTS 4,585,176 4/1986 Kubach et al. .

*Primary Examiner*—Carl E. Hall

*Attorney, Agent, or Firm*—Allan J. Lippa; Peter Abolins

[57] ABSTRACT

A plastic molded fuel rail includes a plurality of core fuel injector assemblies molded within the fuel rail. Each core fuel injector assembly includes a magnetic core, electrical coil bobbin having electrical contacts extending therefrom, and axial fuel passageway. The magnetic core, coil bobbin assembly, and electrical contacts are hermetically sealed from the fuel passageways. An armature and sleeve including a needle and seat valve are inserted into the core fuel injector assemblies to provide fuel injectors. Trimming resistors are appropriately selected connected in series between each fuel injector and a corresponding electronic driver to achieve substantially uniform fuel flow through each fuel injector of the fuel rail.

10 Claims, 5 Drawing Sheets

METHOD OF MAKING INTEGRALLY FORMED AND TUNED FUEL RAIL/INJECTORS

This application is a division of application number 07/630,913, filed Dec. 20, 1990 now U.S. Pat. No. 5,086,743.

BACKGROUND OF THE INVENTION

The field of the invention relates to electromagnetic fuel injectors, fuel rails and processes for fabricating same.

For motor vehicle applications in particular, it is known to mechanically couple a plurality of . electromagnetic fuel injectors between a fuel rail and an intake manifold of an internal combustion engine. In response to an electronic drive signal, the actuated fuel injector passes fuel from the fuel rail into the intake manifold for a predetermined time thereby delivering a predetermined amount of fuel. For accurate fuel delivery, each fuel injector coupled to the fuel rail must deliver substantially the same amount of fuel during the predetermined time of actuation.

A typical fuel injector, which is illustrated herein in Prior Art FIG. 1, is shown connected to fuel rail 102 by fuel connector 6. Fuel injector 10, which is one of a plurality of fuel injectors connected to fuel rail 4, includes housing 12 constructed of an electromagnetic permeable material and having a lower housing 14 crimped to an upper housing 16. Lower housing 14 is fabricated by a conventional cold heading and machining process which forms fuel passageway 18 and cavity 20 for receiving coil bobbin assembly 22 therein. Electrical contacts 24 are positioned through plastic cap 26 and connected to coil bobbin assembly 22 through housing 12. Placement of "O" ring 28 and "O" ring 30 on respective lower housing 14 and upper housing 16 within cavity 20 is required to seal coil bobbin assembly 22 and electrical contacts 24 from fuel passageway 18.

Continuing with Prior Art FIG. 1, armature 34 is slidably, axially mounted within fuel passageway 18 and biased against spring 32. Armature 34 is connected to stem 36 which is axially positioned within sleeve 42 and includes conical end 38. Lower housing 14 is crimped to sleeve 42. Sleeve 42 has a conical seat 46 formed around valve opening 50 for mating with conical end 38 of stem 36 thereby forming a needle and seat valve. Fuel passageway 18 communicates with sleeve 42 and extends through upper housing 16 to fuel connector 6 which mates with fuel rail 4.

During operation, coil bobbin assembly 22 is electrically actuated by a drive signal of predetermined voltage and pulse width. A magnetic field is thereby induced through a magnetic core defined by lower housing 14 and upper housing 16. This induced magnetic field couples to armature 34 deflecting it against spring 32 thereby opening the needle and seat valve. When the drive signal is deactuated, spring 32 downwardly deflects armature 34 thereby closing the needle and seat valve. Accordingly, dynamic fuel flow through the fuel injector is related to spring strength of spring 32, electrical characteristics of coil bobbin assembly 32, and size of valve opening 50.

Prior approaches have also sought to separately adjust fuel delivery through each fuel injector and match sets of fuel injectors to a fuel rail. More specifically, tube 56 is inserted within fuel passageway 58 against spring 32 of prior art fuel injector 12 or similar fuel injector. Fuel injector 12 is then inserted on a test stand (not shown) and tube 56 connected to a stepper motor (not shown) for coupling axial movement to tube 56. A fuel metering probe (not shown) is coupled to fuel passageway 58 which in turn is coupled to a source of pressurized fuel (not shown). A voltage signal is then applied to electrical contacts 24 for a predetermined time and fuel flow measured. Tube 56 is axially displaced, upwardly or downwardly, until a desired fuel flow is measured during such predetermined time. Afterwards, tube 56 is crimped to prevent further movement. In effect, the spring constant of spring 32 is being adjusted to achieve a desired dynamic response. In accordance with the test measurements, a set of closely matched fuel injectors are selected for installation on a particular fuel rail.

The inventor herein has recognized numerous disadvantages of the prior art device and processes described above. For example, the fuel adjusting and fuel injector matching Processes have inherent inaccuracies in addition to manufacturing complexity. A number of test stands are required for efficient manufacturing and each of these stands is calibrated differently. Accordingly, there will be variances between fuel injectors processed on different stands. Further, the measuring probe influences fuel flow through each injector such that the resulting measurements may not accurately reflect actual fuel flow. In addition, only the injectors are adjusted and measured, fuel flow variances are also introduced by the fuel rail.

The inventor herein has also recognized numerous disadvantages of the prior art structural devices, specifically the fuel injector and fuel rail. Numerous processing and assembly steps are required to fabricate a fuel rail and couple each individual fuel injector to the fuel rail through a corresponding fuel connector. Further, for each fuel injector, several "O" rings and corresponding assembly steps are required to seal coil bobbin assembly 22 and electrical contacts 24 from fuel passageway 18. In addition, complicated processing steps are required such as cold heading and machining lower housing 12 to form fuel passageway 18 and cavity 20. Cumbersome crimping steps are also required to assemble lower housing 12 to upper housing 14 and sleeve 42. The magnetically permeable housing is also susceptible to corrosion in typical under hood environments.

SUMMARY OF THE DISCLOSURE

An object of the invention described herein is to provide a fuel rail, including injectors, which are electrically tuned to deliver substantially the same amount of fuel from each injector. Another object is to eliminate the need for a fuel rail which is totally separate from the fuel injectors and eliminate the fuel connectors of prior approaches.

The above described object is achieved, disadvantages of prior approaches overcome, and other objects and advantages obtained by providing a fuel rail with injectors that are electrically tuned such that each injector delivers substantially equivalent fuel flow, and processes for fabricating such apparatus, as claimed herein. In one aspect of the invention, a fuel rail assembly comprises: a plurality of fuel injectors each including an electric coil assembly and valve means mechanically responsive to application of electrical power to the coil assembly for controlling fuel flow through the fuel injector; a plurality of electronic drivers each coupled to a corresponding one of the electric coil assemblies for applying the electrical power; and a plurality of adjusting means each including a separate resistor coupled in series between one of the electrical drivers and one of the electric coils, each of the resistors of the adjusting means having a preselected resistance value determined by operating characteristics of the fuel injector to which the resistor is coupled for maintaining substantially equivalent fuel flow through each of the fuel injectors.

In another aspect of the invention, a method for integrally forming a fuel rail assembly having a plurality of core fuel injector assemblies which are electrically tuned for substantially equivalent fuel flow is provided. One such method comprises the steps of: positioning each of a plurality of electric coil assemblies within a corresponding magnetic core to form a plurality of the core fuel injector assemblies and positioning each of the core fuel injector assemblies within a separable mold; inserting each of a plurality of first removable pins into an opening concentrically formed in each of the core fuel injector assemblies; inserting a second removable pin into the mold which communicates with each of the core fuel injector assemblies; injecting plastic into the mold for hermetically sealing each of the coil assemblies within the corresponding magnetic core for each of the core fuel injector assemblies; removing the first pins to define a fuel passageway in each of the core fuel injector assemblies and removing the second pin to define a fuel path communicating with each of the fuel passageways; removing the separable mold to provide the fuel rail assembly with the plurality of core fuel injector assemblies hermetically sealed therein; inserting each of a plurality of armatures into each of the fuel passageways of the core fuel injector assemblies; coupling each of a plurality of valve assemblies to each of the fuel passageways of the core fuel injector assemblies; and connecting one of a plurality of resistors in series between each one of the coil assemblies and one of an equal plurality of electronic drivers, the resistors being selected with a resistance value to provide substantially equivalent fuel flow through each of the core fuel injector assemblies.

An advantage of the above aspects of the invention is that a fuel rail is provided with substantially equivalent fuel flow through each injector without complicated adjusting steps inherent in prior approaches such as adjusting spring forces. An additional advantage is that the entire fuel rail is tuned for desired fuel delivery.

Another advantage of the above aspect of the invention is that the core fuel injector assemblies, including the magnetic core and coil bobbin assembly, are integrally formed with the fuel rail thereby eliminating the disadvantage of separate fabrication and assembly steps inherent with prior approaches. Another advantage is that the electric coil assembly and associated electrical contacts are hermetically sealed and isolated from the fuel passageway by injection molding plastic during the fabrication process without the need for installing numerous "O" rings or bonding, and sealing the electrical contacts which are disadvantages of prior approaches. The coil assembly is completely surrounded within the molded plastic, and the molding provides a separate fuel path, which eliminates any interfaces which would otherwise require "O" rings or bonding. Still another advantage is that the fuel injector housing is integrally formed from the injection molded plastic thereby eliminating the prior approach processing disadvantages of cold heading, machining, and crimping housing portions together. Another advantage is that the need for a magnetically permeable housing to create the magnetic core and the inherent disadvantage of susceptibility to corrosion is also eliminated.

BRIEF DESCRIPTION OF THE DRAWINGS

The objects and advantages described herein will be more fully understood, and others will become apparent, by reading an example of an embodiment in which the invention is used to advantage, referred to herein as the Preferred Embodiment, with reference to the drawings wherein.

DESCRIPTION OF THE PREFERRED EMBODIMENT

Figure 2:
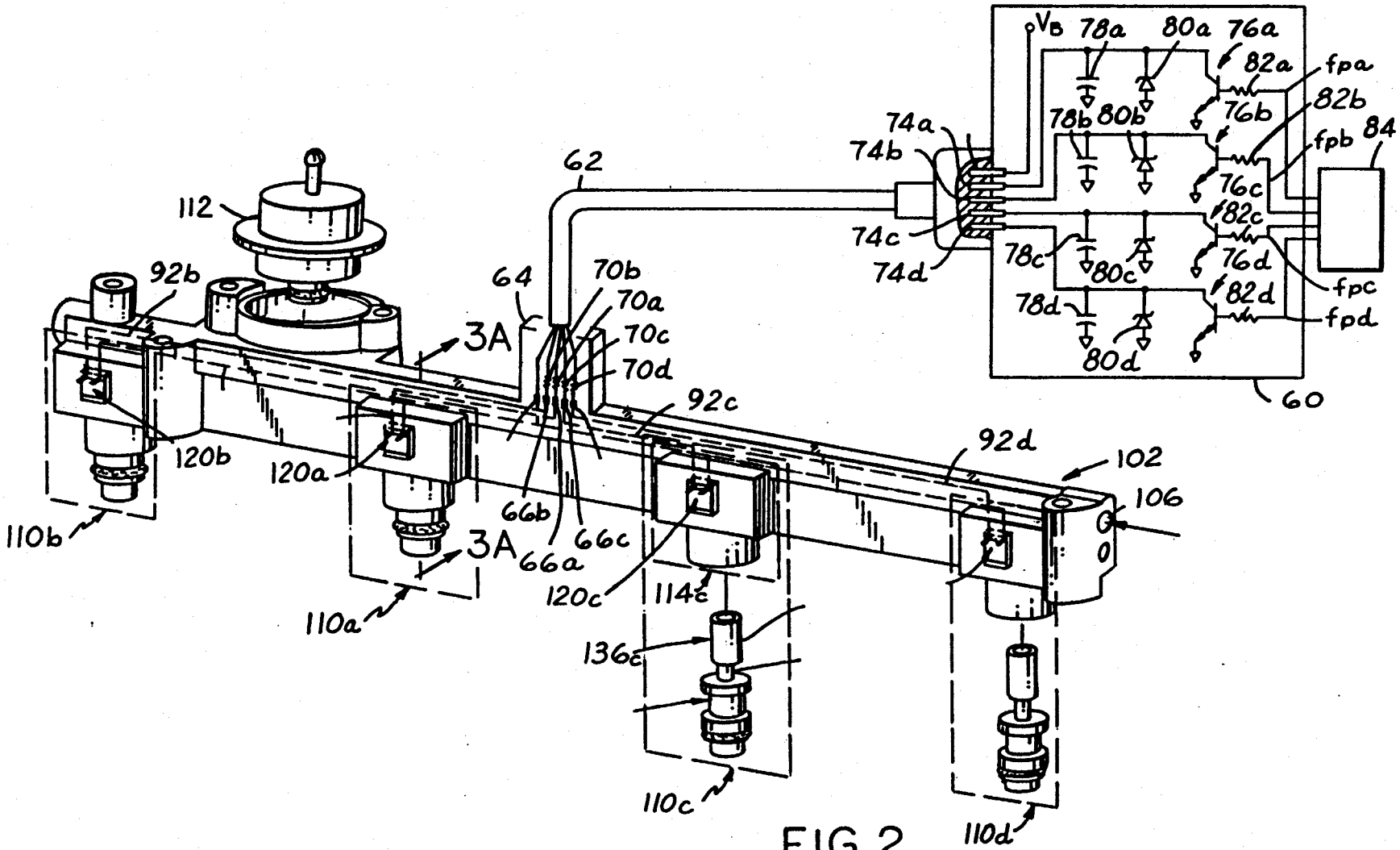
FIG. 2 is a perspective view of an integrally formed fuel rail assembly with fuel injectors coupled to electrical power drivers through tunning resistors positioned on the fuel rail.

Referring first to FIG. 2, integrally formed fuel rail assembly 102 is shown for illustrative purposes having a plurality of fuel injectors **110*a*–110*d*. As described in greater detail later herein, each of the fuel injectors 110*a*–110*d* includes one of the corresponding core fuel injector assemblies 114*a*–114*d*, which are molded within fuel rail 102, and one of the corresponding armature assemblies 136*a*–136*d* inserted within one of the corresponding sleeves 134*a*–134*c*. Fuel rail 102 also includes fuel inlet 106, coupled to a source of fuel such as a fuel pump (not shown), and fuel outlet 108 for returning fuel to a fuel supply or fuel tank (not shown). Conventional pressure regulator 112 is shown coupled to fuel rail 102** for maintaining a desired fuel pressure therein.

In this particular example, fuel injectors **110*a*–110*d* are electronically actuated, via respective pair of electrical contacts 120*a*–120*d* (each pair having a positive and a negative terminal), by conventional fuel controller 60, via respective electrical connector 62. Fuel controller 60 is responsive to voltage signals fpa, fph, fpc, and fpd from engine controller 84 which is described in more detail in U.S. Pat. No. 3,969,614 issued to Moyer and incorporated herein by reference. In response to fuel controller 60, fuel injectors 110***a–d* meter desired quantities of fuel, at desired times, from fuel rail 102 into an intake manifold (not shown) of an internal combustion engine (not shown).

Continuing with FIG. 2, connector board 64 is shown mounted on fuel rail 102 and includes connector tabs 66*a–d*, and connector tab 68. Conductive trace 88 is shown coupled between connector tab 68 and the positive contact of each pair of electrical contacts 120*a–d*. The negative terminal of each pair of electrical contacts 20*a–d* is shown coupled to respective connector tabs 66*a–d* via respective conductive traces 92*a–d*. As described in greater detail later herein conductive traces 88 and 92*a–d* are embedded within fuel rail 102 during the injection molding process. Connector tabs 66*a–d* are coupled to respective connector tabs 74*a–d* and fuel controller 60 via connector cable 62. Similarly, connector tab 60 is coupled to connector tab 72 on fuel controller 60 via connector cable 62. As described later herein trimming resistors 70*a–d* are selected and inserted on connector board 64 in series between respective connector tabs 66*a–d* and 74*a–d*.

Fuel controller 60 is now described with continuing reference to FIG. 2. Connector tab 72 is shown connected to battery voltage $V_B$ for suppling $V_B$ to each positive contact of each pair of electrical contacts 120*a–d*. Conventional Darlington Pair transistors 76*a–d* are each shown having their collector electrodes coupled to respective connector tabs 74*a–d*. Each collector electrode of transistors 76*a–d* is also coupled to the positive plate of respective capacitors 78*a–d*, the negative plate being coupled to electrical ground, for providing ac filtering in a conventional manner. Conventional Zener diodes 80*a–d* are each shown having an anode coupled to electrical return and a cathode coupled to the collector of each transistor 76*a–d* for providing an electrical short to ground should an overload condition occur. The base electrode of each transistor 76*a–d* is shown coupled to respective actuating signals fpa–fpd from electronic engine controller 84 via respective series resistors 82*a–d*.

Figure 1:
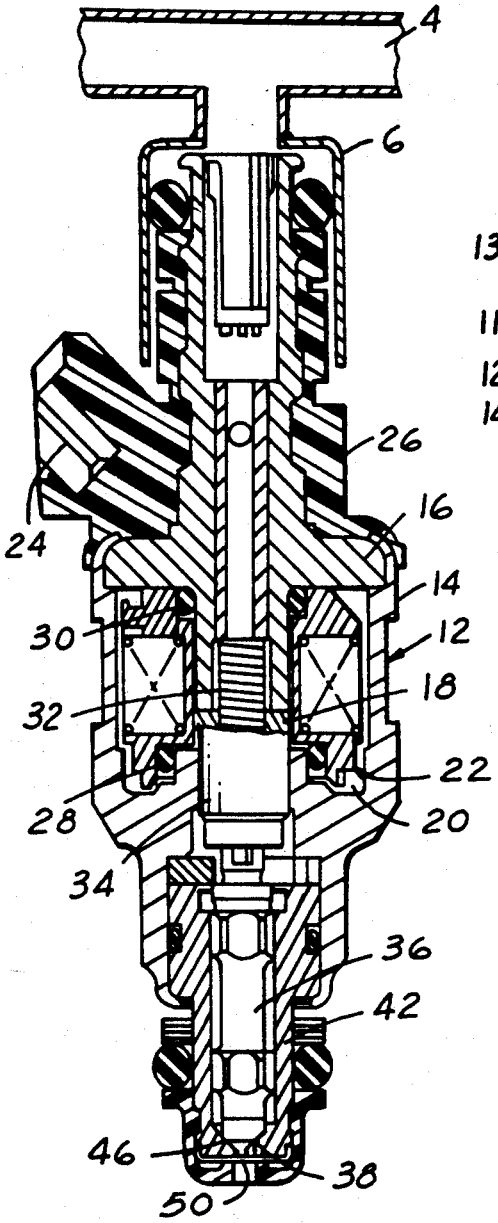
(PRIOR ART) FIG. 1
FIG. 1 is a cross-sectional view of a prior art fuel injector described further in the Background of the Invention section.
Figure 3A:
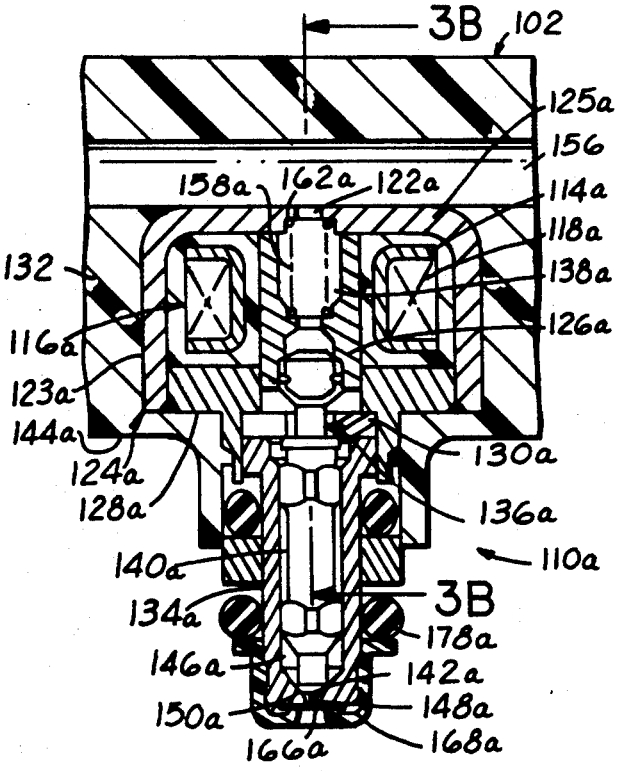
FIG. 3A is a cross-sectional view of a single fuel injector partially embedded within the fuel rail assembly taken along lines 3A—3A in FIG. 2.
Figure 3B:
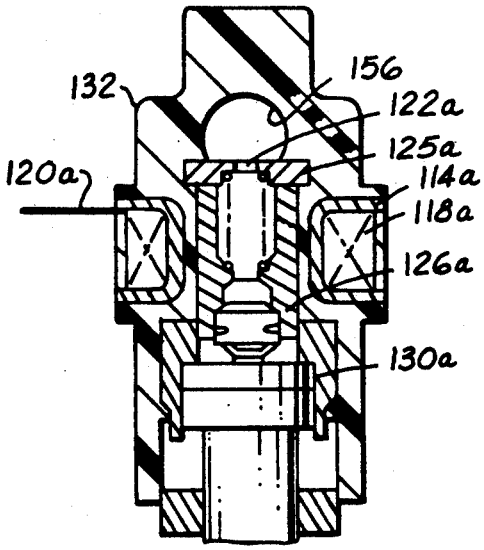
FIG. 3B is a partially broken away and rotated view of FIG. 3A.

A cross-sectional view of a portion of fuel rail 102 and fuel injector 110*a*, taken along line 3A—3A of FIG. 2, is shown in FIG. 3A and FIG. 3B. In this particular example, core fuel injector assembly 114*a* is shown including coil bobbin assembly 116*a* inserted within a stator or magnetic core 124*a*. Coil bobbin assembly 116*a* includes wire 118*a* wound about bobbin 119*a* and having opposing ends connected to pair of electrical contacts 120*a* for connection to fuel controller 60.

As described in greater detail later herein with particular reference to FIGS. 4–6, injection molded plastic 132 seals coil bobbin assembly 116*a* within magnetic core 124*a*, and also forms both housing 144*a* and axial fuel passageway 126*a*. Injection molded plastic 132 also forms fuel rail 102 and fuel path 156 within fuel rail 102 which communicates with fuel passageways 126*a–*126*d*. In addition, molded plastic 132 also seals coil bobbin assembly 116*a* and contacts 120*a* from any fuel flow, such as through axial fuel passageway 126*a*, thereby eliminating the need for a plurality of "O" rings and additional assembly processes which were inherent in prior approaches. In addition, integrally forming a plastic housing around a magnetic core eliminates the need for a magnetic permeable housing which is prone to corrosion and the associated crimping, cold heading, and machining processes which were previously described disadvantages of prior approaches.

Continuing with FIGS. 3A–3B, magnetic core 124*a*, constructed of a magnetic permeable material, includes U-shape strap 123*a* having its open end welded to magnetic permeable assembly 128*a* having axial bore 130*a* formed therein. Sleeve 134*a*, having axially bored fuel passageway 146*a* and valve opening 148*a* circumscribed by conical seat valve 150*a*, is shown coupled to axial bore 130*a*of magnetic core 124*a*. Armature assembly 136*a* is shown including rotor or armature 138*a*, and stem 140*a* having conical needle 142*a* formed thereon for mating with conical seat valve 150*a*. Armature 138*a* is shown including recess 158*a* for positioning return spring 162*a* therein. Armature assembly 136*a* is shown positioned within sleeve 134*a* such that armature 138*a* resides within axial fuel passageway 126*a* and is biased away from upper leg 125*a* of magnetic core 124*a* by return spring 162*a*. Silicon etched nozzles 166*a*, described in U.S. Pat. No. 4,907,748 the specification of which is incorporated herein by reference, is shown communicating with valve opening 148*a* of sleeve 134*a* and attached thereto by retaining cap 168*a*. Retaining cap 168*a* of fuel injector 110*a* is adapted for insertion into the engine intake manifold (not shown) and sealed thereto by "O" ring 178.

During fuel injector operation, electronic engine controller 84, via fuel controller 60, demands a predetermined amount of fuel for delivery to the internal combustion engine by electronically actuating coil bobbin assembly 116*a* a predetermined time via electrical contacts 120*a*. In response, the magnetic field coupled to magnetic core 124*a* via coil bobbin assembly 116*a* axially displaces armature 138*a* in an upward direction against return spring 162*a* thereby displacing needle 142*a* from conical seat valve 150*a*. Fuel then flows from fuel path 156 through axial fuel passageway 126*a* of core fuel injector assembly 114*a*, axial fuel passage 146*a* and valve opening 148*a* of sleeve 134*a*, and silicon etched nozzles 166*a*, into the intake manifold (not shown). When electrical power is removed from coil bobbin assembly 116*a*, return spring 162*a* downwardly deflects armature assembly 136*a* thereby seating needle 142*a* against valve opening 148*a* to stop fuel flow through the injector. Since coil bobbin assembly 116*a* and contacts 120*a* are hermetically sealed from the fuel passageways by injection molded plastic 132, as previously described, fuel flowing through the passageways cannot come in contact with any electrical components. Should the bond between injection molded plastic 132 and magnetic core 124*a* ever develop a slight gap, fuel would still not come in contact with any electrical components, but would simply flow around magnetic core 124*a* and return to the fuel passageways (126*a*, 127*a*, or 146*a*).

The process steps for fabricating fuel rail 102 and fuel injectors 110*a*–110*d* are now described with reference to FIGS. 4–6, wherein like numerals refer to like parts shown in FIGS. 2 and 3A–3B. For ease of illustration, FIGS. 4–6 show only two fuel injectors (110*b* and 110*d*) formed within a portion of fuel rail 102. To further ease the illustration, the following discussion is with reference to only one fuel injector (110*d*), the components and process steps for fabricating being the same for fuel injectors 110*a*–110*d*.

Figure 4:
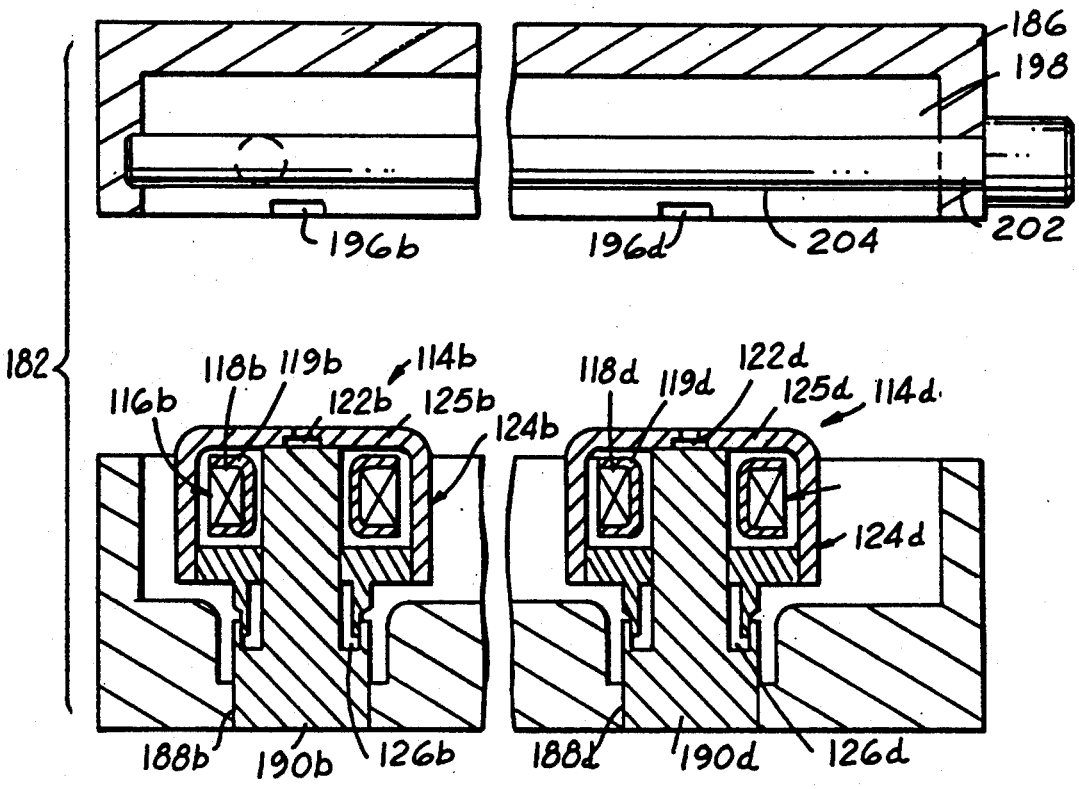
FIG. 4 illustrates placement of various fuel injector components shown in FIG. 2 within a two piece mold for purposes of describing various process steps.

Referring first to FIG. 4, two piece injection mold 182 is shown having lower mold 184 and upper mold 186 in the open position. Lower mold 184 is shown having recess 188*d* with removable pin 190*d* inserted therein. Core fuel injector assembly 114*d* is shown positioned over pin 190*d* within recess 188*d*. As described previously herein, core fuel injector assembly 114*d* includes coil bobbin assembly 116*d*, having wire 118*d* wound on bobbin 119*d* and contacts 120*d* (FIGS. 2 ad 3B) coupled to opposing ends of wire 118*d*, and positioned within magnetic core 124*d*. Pin 190*d* is shown inserted through fuel passageway 126*d* of core fuel injector assembly 114*d* and biased against upper leg 125*d* of magnetic core 124*d*.

Upper mold 186 is shown including injection inlet opening 196*d* communicating with recess 198 which has removable pin 202 disposed therein. Removable pin 202 includes flattened side 204 adapted for flush communication with upper leg 125*d* of magnetic core 124*d* when two piece mold 182 is assembled.

Figure 5:
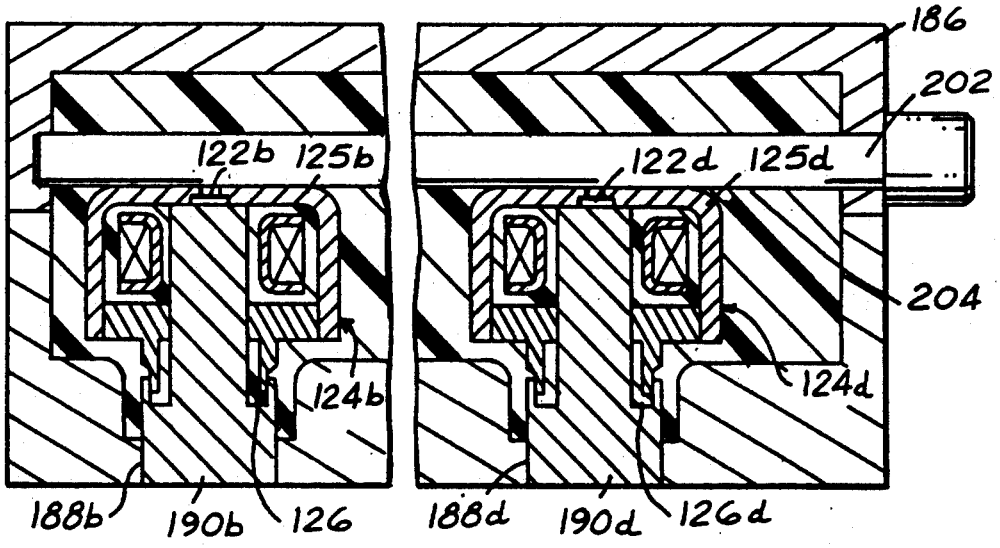
FIG. 5 is an additional illustration of the two piece mold shown in FIG. 4 provided for purposes of describing the process steps herein.

Referring now to FIG. 5, two piece injection mold 182 is shown in the mated position with pin 202 displaced against upper leg 125*d* of magnetic core 124*d*. Plastic as been injected through opening 196 to form fuel rail 102 and hermetically seal coil bobbin assembly 116*d* and magnetic core 124*d* within fuel rail 102.

Figure 6:
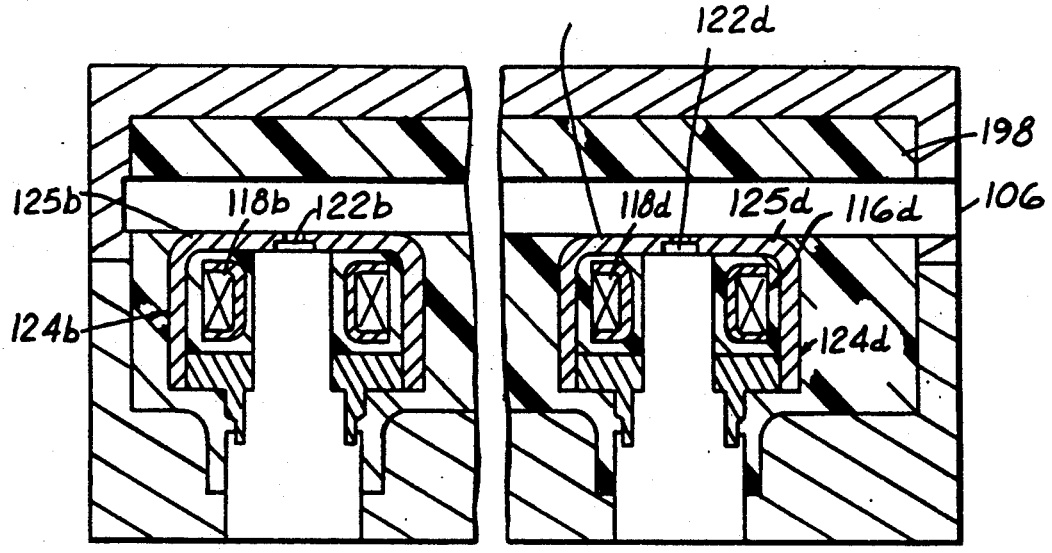
FIG. 6 is an additional illustration of the two piece mold shown in FIG. 4 provided for purposes of describing the process steps herein.

Referring to FIG. 6 and also referring to FIG. 3A, removal of pin 190*d* and pin 202*d* respectively defines axial fuel passageway 126*d* and fuel path 198 which communicate with each other through fuel opening 122*d* in upper leg 125*d* of magnetic core 124*d*.

An assembly process then follows which is more easily understood with reference to FIGS. 2 and 3A–3B wherein like numerals refer to like parts shown in FIGS. 4–6. Silicon nozzle assembly 166*d* is bonded to sleeve 134*d* in communication with valve opening 148*d*. Retaining cap 168*d* is then crimped onto sleeve 134*d* and "O" ring 178*d* positioned on sleeve 134*d*. Armature assembly 136*d*, having return spring 162*d* coupled to armature 138*d*, is inserted into sleeve 136*d* which is then axially inserted into fuel passageway 126*d* of core fuel injector assembly 114*d*. "O" ring 164*d* and retaining ring 170*d* are positioned for sealing sleeve 134*d* to housing 144*d* and completing the fabrication process.

The assembly process continues with reference to FIG. 2 and selection of trimming resistors 70*a–d*. Fuel rail 102 is placed on a test stand (not shown) for measurement of fuel delivered by fuel injectors 110*a–d* during the voltage high state of respective fuel actuation signals fpa–fpd from electronic controller 84. More specifically, a set of trimming resistors 70*a–d* is first inserted on connector board 64. Referring, for example, to fuel injector 110*a*, coil bobbin assembly 116 is connected between $V_B$ and the output electrode of transistor 76*a* via series trimming resistor 70*a*. During the high voltage state of actuation signal fpa, transistor 76*a* is switched to the ON state thereby coupling electrical ground to coil bobbin assembly 116 via trimming resistor 70*a*. Accordingly, coil bobbin assembly is then connected in series between $V_B$ and ground through trimming resistor 70*a* and the dynamic impedance of transistor 76*a*. The test technician sequentially activates fuel injectors 110*a–d* and measures the resulting fuel flow therethrough. Trimming resistors 70*a–d* are then exchanged with trimming resistors of a desired resistance value to achieve substantially equivalent fuel flow through each fuel injector 110*a–d*.

An advantage of the above described process for achieving uniform fuel flow by judicious selection of resistance values, is that substantially equivalent fuel flow is achieved without cumbersome process steps such as the prior approach of altering the spring constant of each fuel injector as described previously. In addition, greater accuracy is achieved because the entire fuel rail is tunned and the need for inserting Probes within the fuel flow path of an injector and the resulting inaccuracy caused thereby is eliminated. Further, each fuel injector is tunned on a single fuel stand thereby eliminating inaccuracies caused by variations among different stands which is a disadvantage inherent in prior approaches.

In addition to the advantages described above, it is readily apparent that these fabrication processes eliminate the prior art need for a separately formed fuel rail, fuel connectors and associated fabrication and assembly steps. In addition, the prior fuel injector requirements for cold heading, machining and crimping. A more reliable fuel injector results requiring fewer assembly steps and sealing components, such as "O" rings, than heretofore possible.

An alternative embodiment is now described with particular reference to FIGS. 7, 8, and 9A–9C wherein like numerals refer to like parts shown in FIGS. 1–6.

Figure 7:
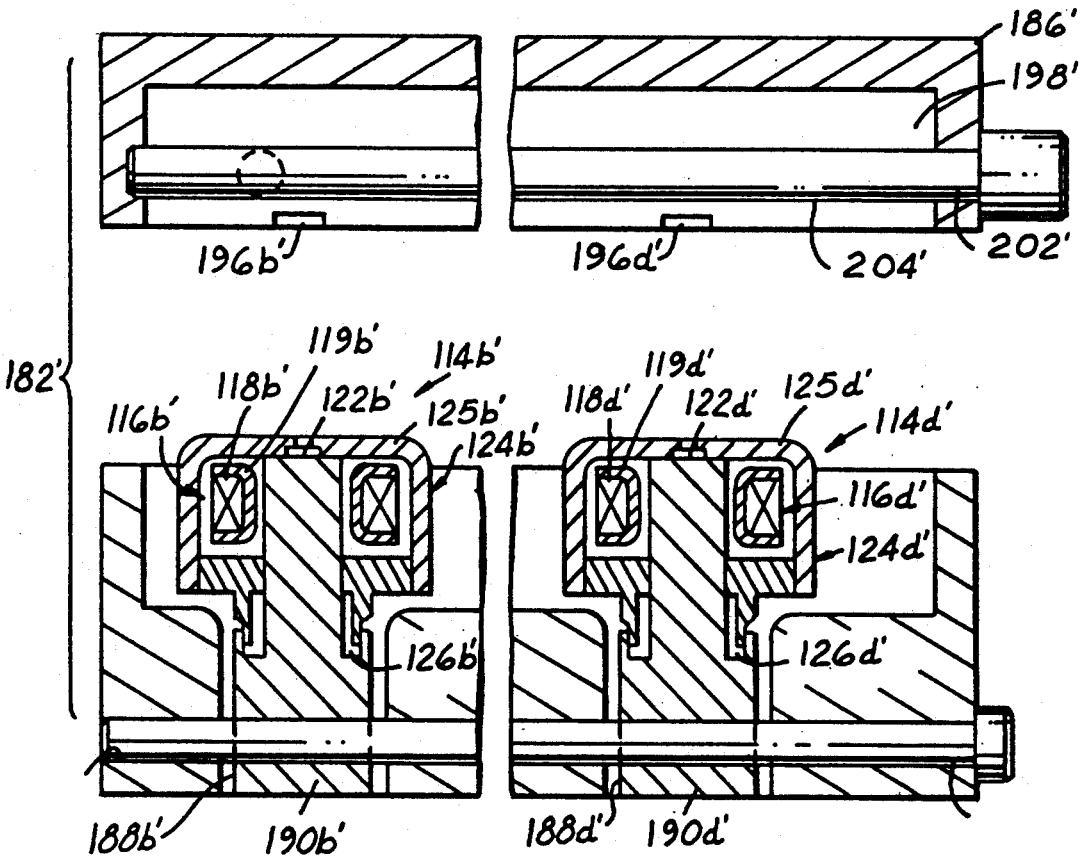
FIG. 7 is an alternate embodiment of the two-piece mold shown in FIG. 4.

Referring first to FIG. 7, two-piece mold 182' is shown. substantially similar to two-piece mold 182 previously described with particular reference to FIGS. 4–6, with the addition of longitudinal pin 220'. Before the injection molding process, longitudinal pin 220' is inserted as shown through pins 190*a–d'*. After the injection molding process which was previously described herein, longitudinal pin 220' is removed thereby defining lower fuel path 220' which communicates with axial fuel passageways 126*a–d'*. The assembly process for fuel injectors 110*a–d'* proceeds as previously described with insertion of sleeves 134*a–c'* and respective armature assemblies 136*a–c'*.

Figure 8:
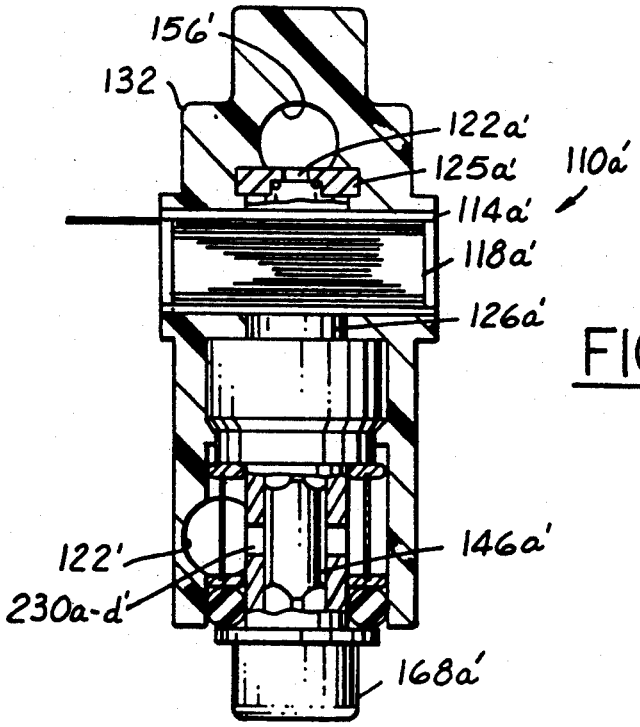
FIG. 8 is a cross-sectional view of a fuel injector partially embedded within a first rail formed in accordance with the embodiment shown in FIG. 7.

In this manner each fuel injectors 110*a–d'* are formed within fuel rail 102' communicating with upper fuel passageway 106' and lower fuel passageway 122' as shown in FIG. 8. In this particular configuration, fuel passageway 122' communicates with axial fuel passageways 146*a–d'* via respective bores 230*a–d'* through respective sleeves 134*a–d'*. Fuel is provided through upper fuel path 106' and excess fuel returned through fuel path 122'. This configuration is shown schematically in FIG. 9C.

Figure 9A:
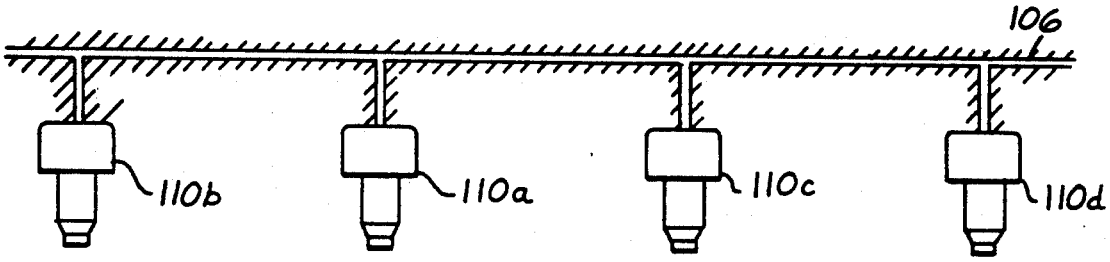
FIGS. 9A–9C are a schematic representation of three alternative fuel connections between the fuel injectors in accordance with the fabrication process shown in FIG. 7.
Figure 9B:
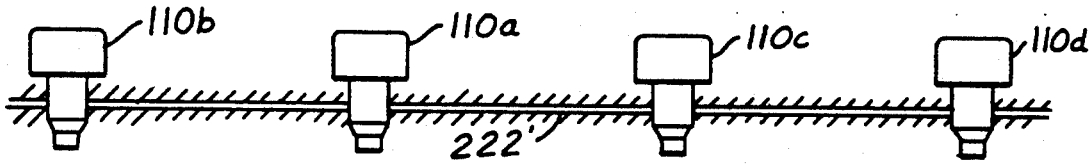

Another alternate embodiment is provided wherein fuel is supplied through lower fuel path 122' as shown schematically in FIG. 9B. This particular configuration is provided by two-piece mold 182' as follows. Pin 202' is not utilized during the molding process. Longitudinal pin 220', however, is utilized to form lower fuel path 222' as previously described. Accordingly, after the injection molding process steps previously described, a fuel injector rail and embedded fuel injectors are formed having fuel feed only through lower fuel path 222'.

Figure 9C:
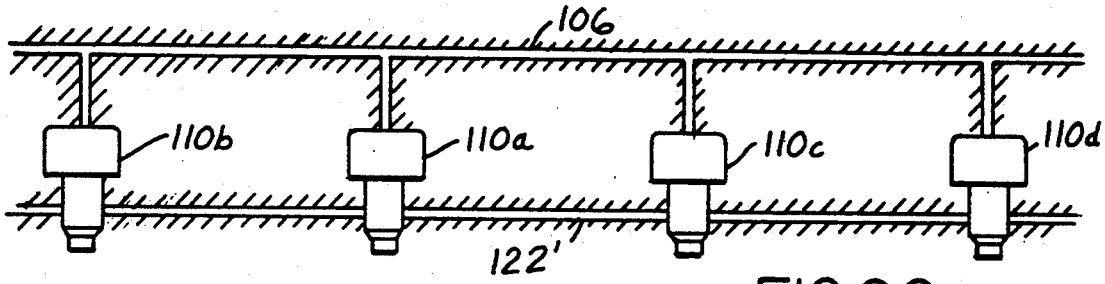

In accordance with the above alternative embodiments, three possible fuel feed figurations are achieved as shown schematically in FIGS. 9A–9C by judicious selection of pins 202' and 220' in two-piece mold 182'. This provides the designer and fabricators with flexibility in providing fuel rails, and also fuel injectors which was not hereto before possible.

This concludes the Description of the Preferred Embodiment. The reading of it by those skilled in the art will bring to mind many alterations and modifications without parting from the spirit and scope of the invention. For example, the fuel injector claimed herein may be used to advantage with magnetic cores and coil bobbin assemblies different from the particular configurations shown in the Description of the Preferred Embodiment. Accordingly, it is intended that the scope of the invention be limited only by the following claims.

What is claimed is:

1. A method for integrally forming a fuel rail assembly having a plurality of core fuel injector assemblies each coupled to a source of fuel, comprising the steps of:

positioning each of a plurality of electric coil assemblies within a corresponding magnetic core to form a plurality of said core fuel injector assemblies and positioning each of said core fuel injector assemblies within a separable mold;

inserting each of a plurality of first removable pins into an opening concentrically formed in each of said core fuel injector assemblies;

inserting a second removable pin into said mold which communicates with each of said core fuel injector assemblies;

injecting plastic into said mold for forming said fuel rail assembly with said plurality of core fuel injector assemblies hermetically sealed therein and hermetically sealing each of said coil assemblies within said corresponding magnetic core for each of said core fuel injector assemblies;

removing said first pins to define a fuel passageway in each of said core fuel injector assemblies and removing said second pin to define a fuel path communicating with each of said fuel passageways;

removing said separable mold;

inserting each of a plurality of armatures into each of said fuel passageways of said core fuel injector assemblies;

coupling each of a plurality of valve assemblies to each of said fuel passageways of said core fuel injector assemblies; and connecting one of a plurality of resistors in series between each one of said coil assemblies and one of an equal plurality of electronic drivers, said resistors being selected with a resistance value to provide substantially equivalent fuel flow through each of said core fuel injector assemblies.

2. The method recited in claim 1 further comprising the steps of coupling each of a plurality of nozzle assemblies to each of said valve assemblies.

3. The method recited in claim 1 further comprising the steps of inserting each of a plurality of springs between each of said armatures and a corresponding magnetic core.

4. A method for integrally forming a fuel rail assembly having a plurality of core fuel injector assemblies each coupled to a source of fuel, comprising the steps of:

positioning each of a plurality of electric coil assemblies within a corresponding magnetic core to form a plurality of said core fuel injector assemblies and positioning each of said core fuel injector assemblies within a separable mold;

injecting plastic into said mold for forming said fuel rail assembly with said plurality of core fuel injector assemblies hermetically sealed therein and hermetically sealing each of said coil assemblies within said corresponding magnetic core for each of said core fuel injector assemblies;

removing said separable mold;

coupling one of a plurality of resistors to each one of said electric coil assemblies hermetically sealed within said fuel rail assembly.

5. The method recited in claim 4 further comprising a step of connecting a separate electrical conductor to each of said electric coil assemblies within said mold and extending each of said electrical conductors to a surface of said mold for forming an electrical tab on a surface of said fuel rail assembly.

6. The method recited in claim 5 wherein said step of coupling said resistors further comprises a step of coupling each of said resistors to a corresponding one of said electrical tabs.

7. A method for integrally forming a fuel rail assembly having a plurality of core fuel injector assemblies each coupled to a source of fuel, comprising the steps of:

forming a plurality of said core fuel injector assemblies by positioning each of a plurality of electric coil assemblies within a corresponding magnetic core and positioning each of said core fuel injector assemblies within a separable mold;

inserting each of a plurality of first removable pins into an opening concentrically formed in each of said core fuel injector assemblies;

inserting a second removable pin into said mold communicating with each of said core fuel injector assemblies;

injecting plastic into said mold for forming said fuel rail assembly with said plurality of core fuel injector assemblies hermetically sealed therein and hermetically sealing each of said coil assemblies within said corresponding magnetic core for each of said core fuel injector assemblies;

removing said first pins to define a fuel passageway in each of said core fuel injector assemblies and removing said second pin to define a fuel path communicating with each of said fuel passageways; and coupling one of a plurality of resistors to each one of said electric coil assemblies hermetically sealed within said fuel rail.

8. The method recited in claim 7 wherein said step of inserting said second removable pin includes contacting said second removable pin against said magnetic core.

9. The method recited in claim 7 wherein said step of inserting said second removable pin includes contacting said second removable pin against each of said first removable pins.

10. The method recited in claim 8 further comprising a step of inserting a third removable pin in contact with each of said first removable pins.

* * * * *